US006744146B2

(12) United States Patent
Fulton et al.

(10) Patent No.: US 6,744,146 B2
(45) Date of Patent: Jun. 1, 2004

(54) ELECTRICAL CIRCUIT FOR PROVIDING A REDUCED AVERAGE VOLTAGE

(75) Inventors: David A. Fulton, Anderson, IN (US); William Cai, Carmel, IN (US)

(73) Assignee: Delco Remy America, Inc., Anderson, IN (US)

( * ) Notice: Subject to any disclaimer, the term of this patent is extended or adjusted under 35 U.S.C. 154(b) by 86 days.

(21) Appl. No.: 10/234,113

(22) Filed: Sep. 5, 2002

(65) Prior Publication Data

US 2004/0046393 A1 Mar. 11, 2004

(51) Int. Cl.[7] ..... F02N 11/00
(52) U.S. Cl. ..... 290/37 A; 290/40 C; 322/40
(58) Field of Search ..... 290/30 R, 31, 290/36 R, 37 A, 38 A; 322/40; 123/339.16

(56) References Cited

U.S. PATENT DOCUMENTS 4,170,211 A * 10/1979 Worthington ..... 123/179.3
5,493,201 A * 2/1996 Baker ..... 322/10
5,561,330 A * 10/1996 Crook ..... 290/30 R
5,589,743 A * 12/1996 King ..... 318/139
5,691,576 A * 11/1997 Minks ..... 307/10.7
5,925,938 A * 7/1999 Tamor ..... 290/31
5,975,058 A * 11/1999 French et al. ..... 123/490
6,018,199 A * 1/2000 Shiroyama et al. ..... 290/37 A
6,308,688 B1 * 10/2001 French et al. ..... 123/490

OTHER PUBLICATIONS

Hidetoshi Kusumi et al., "42V Power Control System for Mild Hybrid Vehicle (MHV)," SAE Technical Paper Series 2002–01–0519, Mar. 4–7, 2002, SAE 2002 World Congress, ISSN 0148–7191.

* cited by examiner

*Primary Examiner*—Nicholas Ponomarenko
(74) *Attorney, Agent, or Firm*—Finnegan, Henderson, Farabow, Garrett & Dunner, L.L.P.

(57) ABSTRACT

Systems and methods of the invention may utilize integrated starter-alternator (ISA) electronics to drive a conventional DC starter coupled to a start-stop ISA system providing a voltage higher than that at which the starter is rated. The DC starter may cold crank an internal combustion engine, while a poly-phase starter alternator warn cranks the engine and converts mechanical energy to an AC current. The AC current may be converted to a DC current to provide charging functions. A reduced average voltage is provided to the DC starter and an adjustable-frequency alternating current may be provided to the starter alternator.

42 Claims, 10 Drawing Sheets

(Conventional Starter)

ELECTRICAL CIRCUIT FOR PROVIDING A REDUCED AVERAGE VOLTAGE

TECHNICAL FIELD

The present invention generally relates to electrical systems. More particularly, the invention involves enabling an electrical device rated at a particular voltage to function in a system supplying a higher voltage. In one implementation, the invention may involve using integrated starter-alternator electronics as a pulse-width modulation drive for a conventional starter of an internal combustion engine.

DESCRIPTION OF THE RELATED ART

Several integrated starter-alternator (ISA) systems have been proposed for providing starting and charging functions to an internal combustion engine. Such ISA systems are often driven by a crankshaft, belt, or chain. One configuration of a typical belt driven ISA system is illustrated in system 10 of FIG. 1. As illustrated, system 10 may include an inverter (102), which is connected to a direct current (DC) voltage source (e.g., battery 105), that drives an alternating current (AC) electrical device, such as starter-alternator 115, during engine cranking. After the engine (101) starts, the same electronics provide rectification for charging the DC voltage source.

Often, ISA systems are vital to engine stop-start systems. A stop-start system may be used to shut off an engine during prolonged idle periods and restart the engine in response to changes in throttle or clutch position. Consequently, start-stop systems can be used to reduce emissions and fuel consumption. However, a typical start-stop system for an internal combustion engine in a vehicle may start an engine 500,000 times over a 150,000 mile lifetime. This high cycle requirement is prohibitive for cranking with a conventional starter. In contrast, ISA systems are well suited to the task since they are brushless and designed for continuous operation.

In addition to durability, stop-start systems typically require ISAs to have high crank speeds to keep start-up emissions low. High crank speeds are also needed to minimize starting times and to avoid noticeable lag times in, for example, traffic flow. This high crank speed requirement translates into a high starter power output requirement.

In automotive applications, conventional starters output between 1.4 to 1.7 kW. However, stop-start systems require ISAs that output 4 to 8 kW. Thus, despite the higher efficiency of ISAs (typically 75–85% compared to 50% for conventional starters), higher battery power is required for start-stop systems. A start-stop ISA system may require a battery with three times the available power of a conventional starter. A typical ISA battery is 36 volts (V), compared to 12V for a conventional starter. The higher voltage system allows more power to be delivered at the same current using the same cable size.

There are, however, several difficulties involved in using ISAs (especially belt driven systems) for cold engine cranking. It is difficult, due to size, to package ISAs, which can provide adequate cold crank torque, as an accessory on existing engines. Also, the mass moment of inertia of a large rotor in such an ISA system produces high belt loads and increased fuel consumption during acceleration. Additionally, in order to transmit cold crank torque, a higher than normal belt tension is required. As a result, a wider belt and larger bearings are required in the engine and belt loop components.

A conventional starter can be added to a start-stop ISA system to provide the cold cranking ability. The number of cold starts over the life of a vehicle is well within the durability limit of a conventional starter. As FIG. 2 illustrates, a conventional starter 210 can be coupled to, or included in, system 10. The conventional starter is used for cold cranking and is powered by a standard 12V cranking battery with relatively high cold cranking amps and low reserve capacity (e.g., battery 209). For warm cranking, when cranking torque is low, the ISA is used with a high power 36V battery (e.g., battery 105).

As depicted in FIG. 2, start-stop ISA systems employing conventional starters often include a 12V battery (209) to drive the starter. However, a typical 12V battery has low reserve capacity, which is prohibitive for powering certain loads, such as lamps and radios. Further, an extra 12V battery adds weight to a vehicle and consumes valuable space. There are system architectures in which the 12V battery is eliminated and all loads are powered by a 36V battery. However, powering a conventional starter directly from a 36V requires matching the battery power to the power rating of the starter.

Moreover, it is not possible to make an equivalent size conventional starter capable of handling a 36V battery sized for a stop-start ISA system. Even if the conventional 12V starter were rewound for 36V, the resulting high current draw would damage the starter by overheating, demagnetization, and/or contact welding. For these and other reasons, it is beneficial to utilize ISA electronics to drive a conventional starter.

SUMMARY

The present invention is directed to methods and systems that substantially obviate one or more of the above problems and other problems by enabling an electrical device rated at a particular voltage to operate in an electrical system providing a higher voltage. This may be accomplished without an additional low power battery and without matching the existing battery power to the power rating of the device. Although the present invention, in its broadest sense, is not restricted to start-stop ISA systems, such systems are used here to convey aspects of the invention.

One aspect of the instant invention involves generating a reduced average voltage from an electrical system. The instant invention may, for example, enable a conventional 12V starter to operate in a start-stop ISA system having a 36V voltage source.

Systems consistent with principles of the instant invention may comprise a combination of elements including an electrical device rated at a particular voltage, an AC load, and a voltage source supplying a voltage higher than that at which the electrical device Is rated. In one implementation, the electrical device could be a starter mechanism coupled to, or included in, a start-stop ISA system and used for cold cranking an internal combustion engine. The starter mechanism may include a DC motor rated at a particular voltage, for example, 12 volts. Consistent with one implementation, the AC load could be a poly-phase starter-alternator mechanism configured for warm cranking the engine, i.e., cranking the engine after periods of extended Idle in response to changes in clutch or throttle position. The starter-alternator may also convert rotational energy produced by the engine into an AC current in order to charge the voltage source and/or provide power to other devices. The starter-alternator mechanism may require, and therefore the voltage source may provide, a voltage higher than that at which the starter is rated (e.g., 36V).

Consistent with principles of the present invention, a reduced average voltage may be provided to the electrical device by way of an electrical circuit. For instance, the voltage source may supply 36 volts and the electrical circuit may provide 12 volts to the device. This reduced average voltage may be produced via one or more switching devices. In one configuration, the switching devices may be included in an inverter/converter circuit coupled to an ISA system. In addition, the electrical circuit may provide the reduced average voltage in response to a switch (e.g., an electromechanical switch) triggered by a key-driven or push-button starter switch.

In addition to providing the reduced average voltage, the electrical circuit may be configured to drive an AC load of a chosen frequency and phase. That is, the circuit may be configured to provide an adjustable-frequency alternating current to the AC load from the DC voltage source. In one configuration, the circuit may, in response to the switch opening, cease to provide the reduced average voltage to the electrical device and transfer energy from the DC voltage source to the AC load. Consistent with one implementation, where the AC load is a starter-alternator device, the electrical circuit may also enable the DC voltage source to be charged via AC current obtained from the engine rotation.

Additional aspects related to the invention will be set forth in part in the description which follows, and in part will be obvious from the description, or maybe learned by practice of the invention. Aspects of the invention may be realized and attained by means of the elements and combinations particularly pointed out in the appended claims.

It is to be understood that both the foregoing and the following descriptions are exemplary and explanatory only and are not intended to limit the claimed invention in any manner whatsoever.

BRIEF DESCRIPTION OF THE DRAWINGS

The accompanying drawings, which are incorporated in and constitute a part of this specification, exemplify the present invention and, together with the description, serve to explain principles of the invention.

DETAILED DESCRIPTION

Figure 1:
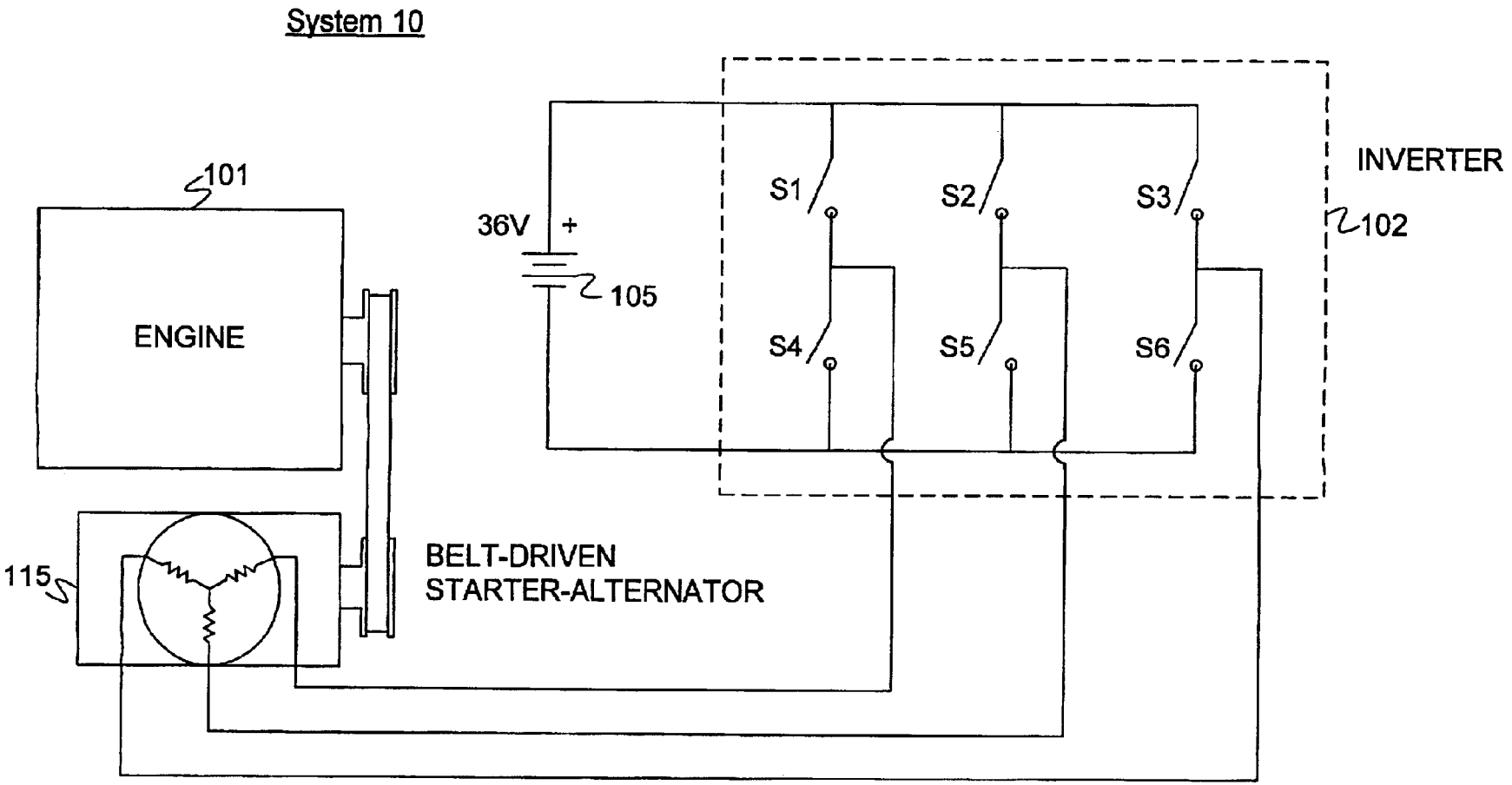
FIGURE 1 (Prior Art)
FIG. 1 is an exemplary block diagram of a conventional system.
Figure 2:
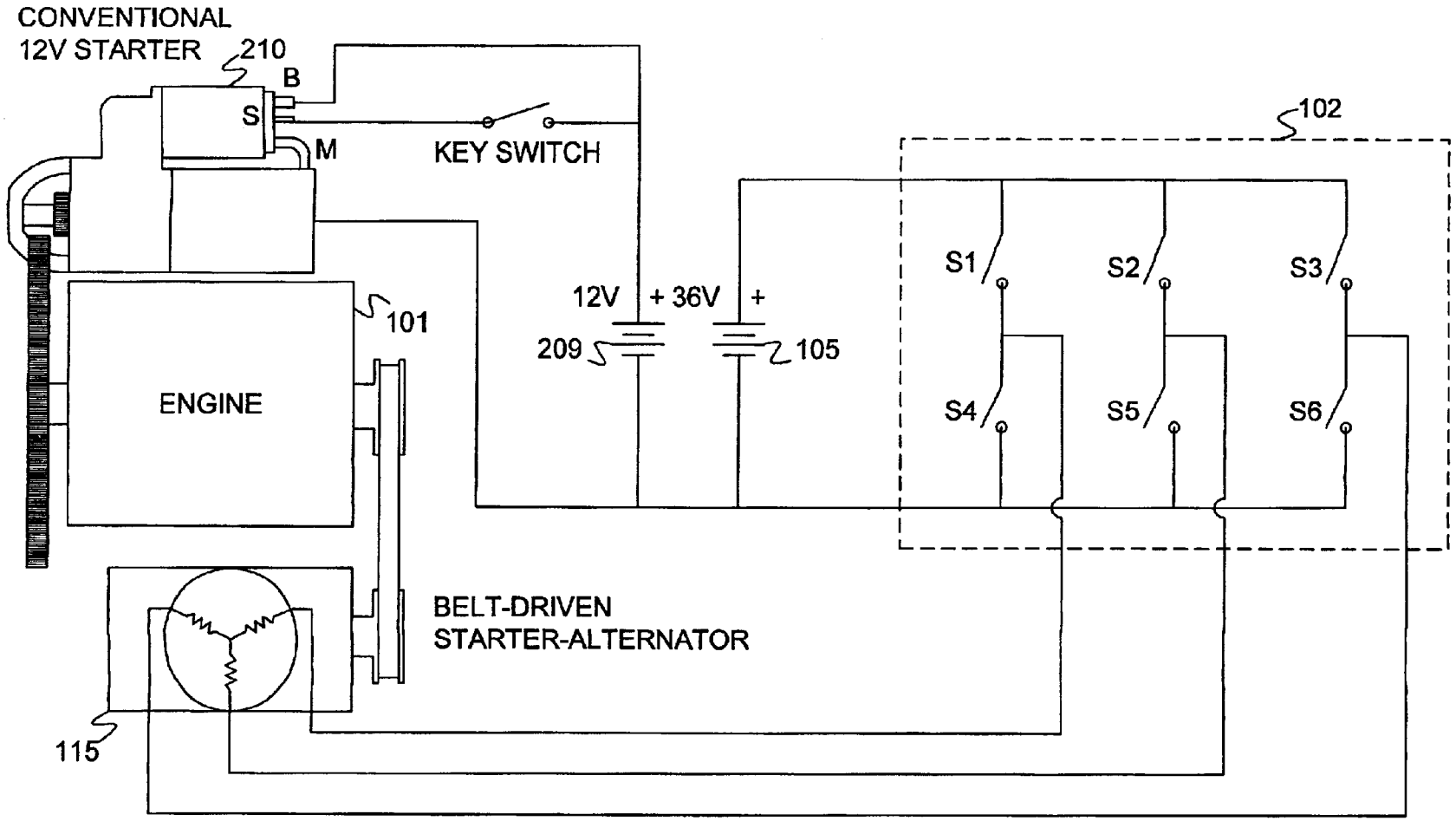
FIGURE 2 (Prior Art)
FIG. 2 is an exemplary block diagram of another conventional system.

In the following detailed description reference will be made to the accompanying drawings in which is shown by way of illustration specific implementations consistent of the instant invention. These implementations are described in sufficient detail to enable those skilled in the art to practice the invention, and it is to be understood that other implementations may be utilized and that structural changes may be made without departing from the scope of present invention. The following detailed description is, therefore, not to be construed in a limited sense whatsoever.

The present invention may enable an electrical device to operate in an electrical system providing a voltage higher than that at which the electrical device is rated. In one implementation, the invention may provide a reduced average voltage to a DC starter motor coupled to, or included in, a start-stop ISA system. Accordingly, systems consistent with principles of the instant invention may include an electrical device rated at a particular voltage (e.g., 12V), an AC load, and a voltage source. In one implementation, the electrical device could be a DC starter motor for cold cranking an internal combustion engine. Consistent with such an implementation, the AC load could be a poly-phase starter alternator mechanism for warm cranking the engine and converting mechanical energy produced by the engine into an AC current.

In one configuration, the AC load may require, and the voltage source may therefore provide, a voltage higher than that at which the electrical device is rated (e.g., 36V). Accordingly, an electrical circuit may be provided for driving the electrical device with the voltage source by way of a reduced average voltage. In accordance with principles of the invention, the circuit may generate the reduced average voltage via one or more switching devices. In one configuration, the reduced average voltage may be provided in response to an electromechanical switch closing.

Consistent with principles of the invention, the switching devices may be sequentially switched to provide an adjustable-frequency alternating current to the AC load. This may involve generating a set of voltages substantially equal in magnitude and respectively displaced by a phase angle. For example, the circuit may generate a set of the three voltages, each displaced by a phase voltage of 120 degrees. The circuit may also be configured to convert mechanical (e.g., rotational) energy into an AC current, which may in turn be converted to a DC current for charging the voltage source.

Referring now to the drawings, in which like numerals represent like elements throughout the figures, the invention Will be described.

Figure 3:
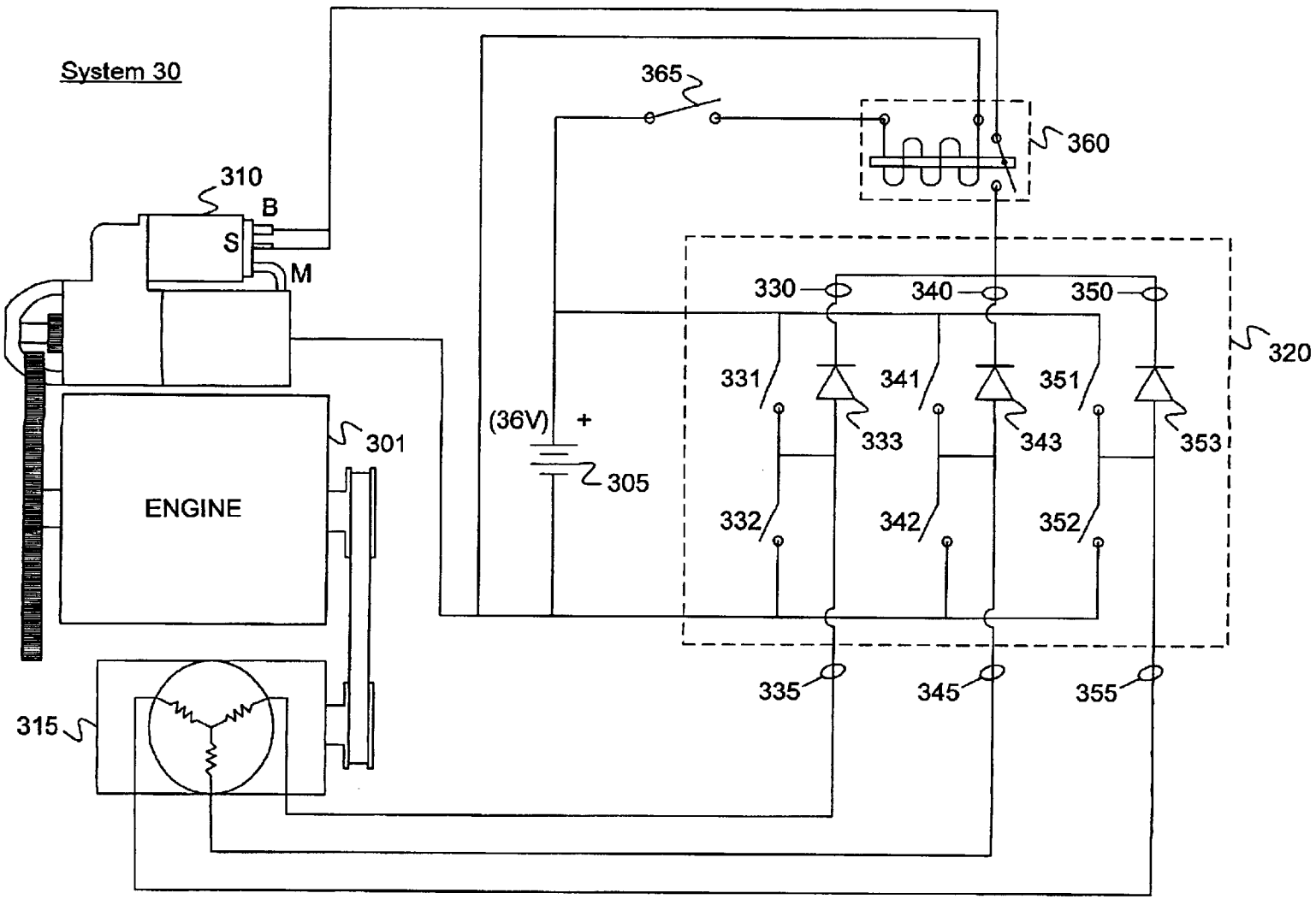
FIG. 3 is an exemplary block diagram of an electrical system in which the present invention may be practiced.

In one exemplary implementation, the invention may be practiced in a start-stop ISA system, such as system 30 of FIG. 3. System 30 may comprise an engine 301, a voltage source 305, a starter 310, a starter-alternator 315, and an electrical circuit 320. Engine 301 may be any device, mechanism, or machine for converting energy into force. For example, engine 301 may be a diesel or gas-fueled internal combustion engine including a throttle and a clutch. Starter 310 may be coupled to engine 301 and configured for cold cranking the engine. Starter 310 may, in one configuration, be a conventional DC starter motor assembly rated at a particular voltage (e.g., 12V). It should, however, be understood that starter 310 may be any DC device, mechanism, or machine capable of cranking engine 301 by way of mechanical force.

Figure 3A:
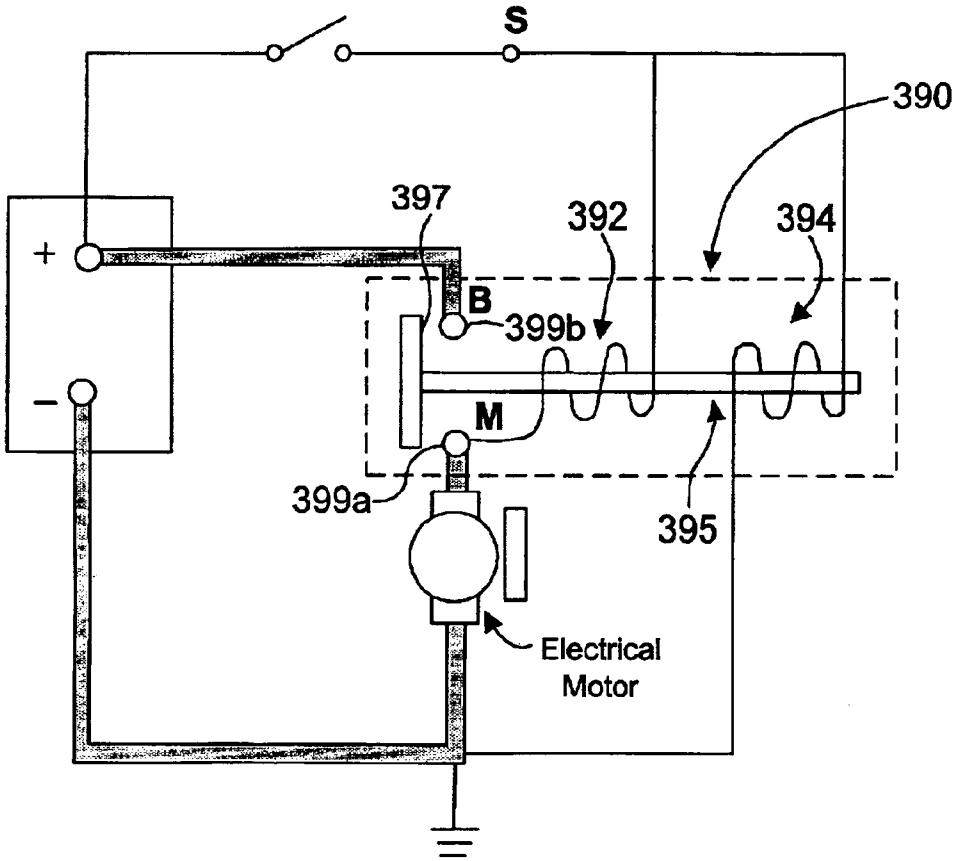
FIG. 3A is an electrical circuit diagram of one embodiment of a starter motor assembly consistent with the present invention.

One example of a conventional starter assembly Is illustrated in FIG. 3A. As shown in FIG. 3A, a solenoid assembly 390 may include a battery "B" contact and a solenoid "S" contact fixed to a pinion housing. Energization of solenoid assembly 390 may utilize coils including a pull-in coil 392 and a hold-in coil 394. As FIG. 3A illustrates, the assembly may also include a plunger 395, which may be shifted axially when pull-in coil 392 and hold-in coil 394 are energized. In operation, energizing coils 392 and 394 may cause plunger 395 to shift in a direction which causes a moveable contact 397 to engage a pair of fixed electrical contacts 399*a*, 399*b*. The movement of plunger 395 may cause a pinion to engage with an engine flywheel.

As FIG. 3 illustrates, starter-alternator 315 may also be coupled to engine 301. Starter-alternator 315 may be any device, mechanism, or machine capable of starting engine 301 by way of electrical and/or mechanical force and/or converting energy produced by engine 301 into an AC current. Starter-alternator 315 may be driven by a crankshaft, belt, chain, or any other medium. In exemplary implementations, starter-alternator 315 may be poly-phase and may require more power than starter 310. For example, as FIG. 3 illustrates, starter-alternator 315 may be a 36V, three-phase ISA.

In one implementation, starter-alternator 315 may be configured for "warm cranking" engine 301. As used herein, the term "warm cranking" refers to starting engine 301, by way of mechanical force (e.g., rotary motion), after periods of extended idle in response to changes in clutch and/or throttle position. Thus, starter-alternator 315 may be capable of performing substantially more starts than starter 310. Starter-alternator 315 may also be configured to convert energy produced by engine 301 into an AC current in order to charge voltage source 305. This AC current may, in one configuration, be derived from rotational energy.

Voltage source 305 may be any mechanism capable of generating electrical energy. In one implementation, voltage source 305 may include one or more series-connected chemical cells for producing a DC voltage. Voltage source 305 may provide an amount of voltage compatible with the requirement of starter-alternator 315, for example, 36V.

As depicted in FIG. 3, electrical circuit 320 may be coupled to voltage source 305, starter 310, and starter-alternator 315. Consistent with principles of the invention, circuit 320 may comprise one or more switching devices (e.g., 331, 332, 341, 342, 351, and 352). Switching devices 331, 332, 341, 342, 351, and 352 may each be any mechanism for connecting, disconnecting, and/or diverting electrical current, such as a bipolar junction transistor (BJT), a metal oxide semiconductor field-effect transistor (MOSFET), a junction field-effect transistor (JFET), a thyristor, a power field-effect transistor (VMOS), or any other switching component. One skilled in the art will realize that electrical circuit 320 may comprise any number and combination of such switching devices.

Electrical circuit 320 may also comprise one or more heat sinks for transferring heat from the switching devices. The heat sink(s) (not illustrated) may transfer heat from the switching devices via conduction, convection, and/or radiation.

As illustrated in FIG. 3, switching devices 331, 332, 341, 342, 351, and 352 may be coupled to each phase of starter-alternator 315 via terminals 335, 345, and 355. In one implementation, the switching devices may be arranged in a bridge configuration. However, one skilled in the art will realize that switching devices 331, 332, 341, 342, 351, and 352 may be arranged in other alternative configurations known in the art, such as are commonly employed with permanent magnetic synchronous, multi-phase induction, and switch reluctance machines. In addition, it should be understood that the number of switching devices included in electrical circuit 320 may vary with the number of phases accommodated by the system. For example, in a four-phase implementation electrical circuit 320 may comprise eight switching devices arranged in a bridge (or other) configuration.

In exemplary implementations, circuit 320 may provide power to starter-alternator 315. Since starter-alternator 315 may be poly-phase, electrical circuit 320 may be configured to transfer energy from voltage source 305 to an AC load of arbitrary frequency and phase. That is, electrical circuit 320 may be configured to generate an adjustable-frequency alternating current from DC voltage source 305. Electrical circuit 320 may transfer energy to an n-phase load by way of providing a set of n voltages substantially equal in magnitude and respectively displaced by a phase angle of 360°/n. For example, circuit 320 may provide starter-alternator 315 with a set of three voltages, each displaced by a phase angle of 120 degrees. In one configuration, switching devices 331, 332, 341, 342, 351, and 352 may be sequentially switched to provide the adjustable-frequency alternating current. A skilled artisan will realize that a controller mechanism may be coupled to electrical circuit 320 for setting the chosen frequency and/or voltage.

In addition to driving starter-alternator 315, electrical circuit 320 may be configured to provide starter 310 with a reduced average voltage. That is, circuit 320 may serve as a DC chopper, enabling a high power battery to drive a low power device. As previously explained, starter 310 may require less power than starter-alternator 315. For example, starter 310 may be rated at 12V, while starter-alternator 315 may require, and voltage source 305 may therefore provide, 36V. Accordingly, electrical circuit 320 may generate and provide starter 310 with a reduced average voltage (e.g. 12V) from voltage source 305.

In one implementation, the reduced average voltage may be generated via switching devices 331, 332,.341, 342, 351, and 352 and may be pulse-width modulated (PWM). The reduced average voltage may also be hysteretic and/or may be generated by any other chopper technique. Thus, in addition to serving as an inverter/converter for starter-alternator 315, switching devices 331, 332, 341, 342, 351, and 352 may function as a DC chopper having three output terminals (330, 340, 350).

As FIG. 3 illustrates, the output terminals 330, 340, and 350 may be connected at a single point coupled to switch 360. As also illustrated, switch 360 may, in turn, be coupled to starter 310. In addition, switch 360 may be coupled to voltage source 305.

Switch 360 may be any mechanism for connecting, disconnecting, and/or diverting electrical current in response to an electromagnetic field. In one configuration, depicted in FIG. 3, switch 360 may be any type of electromechanical switch, such as a SPST (Single Pole, Single Throw) magnetic switch. Consistent with such a configuration, diodes 333, 343, and 353 may be coupled in series with output terminals 330, 340, and 350, respectively, in order to prevent circuit 320 from short-circuiting when switch 360 opens (i.e., when driving starter-alternator 315). Although FIG. 3 illustrates three diodes, it should be understood that any number of diodes may be included in electrical circuit 320, depending on the number phases of the system and the configuration of the switching devices. In addition, any other device, mechanism, or element for preventing current from flowing may be used in place of any of the diodes illustrated.

Figure 4:
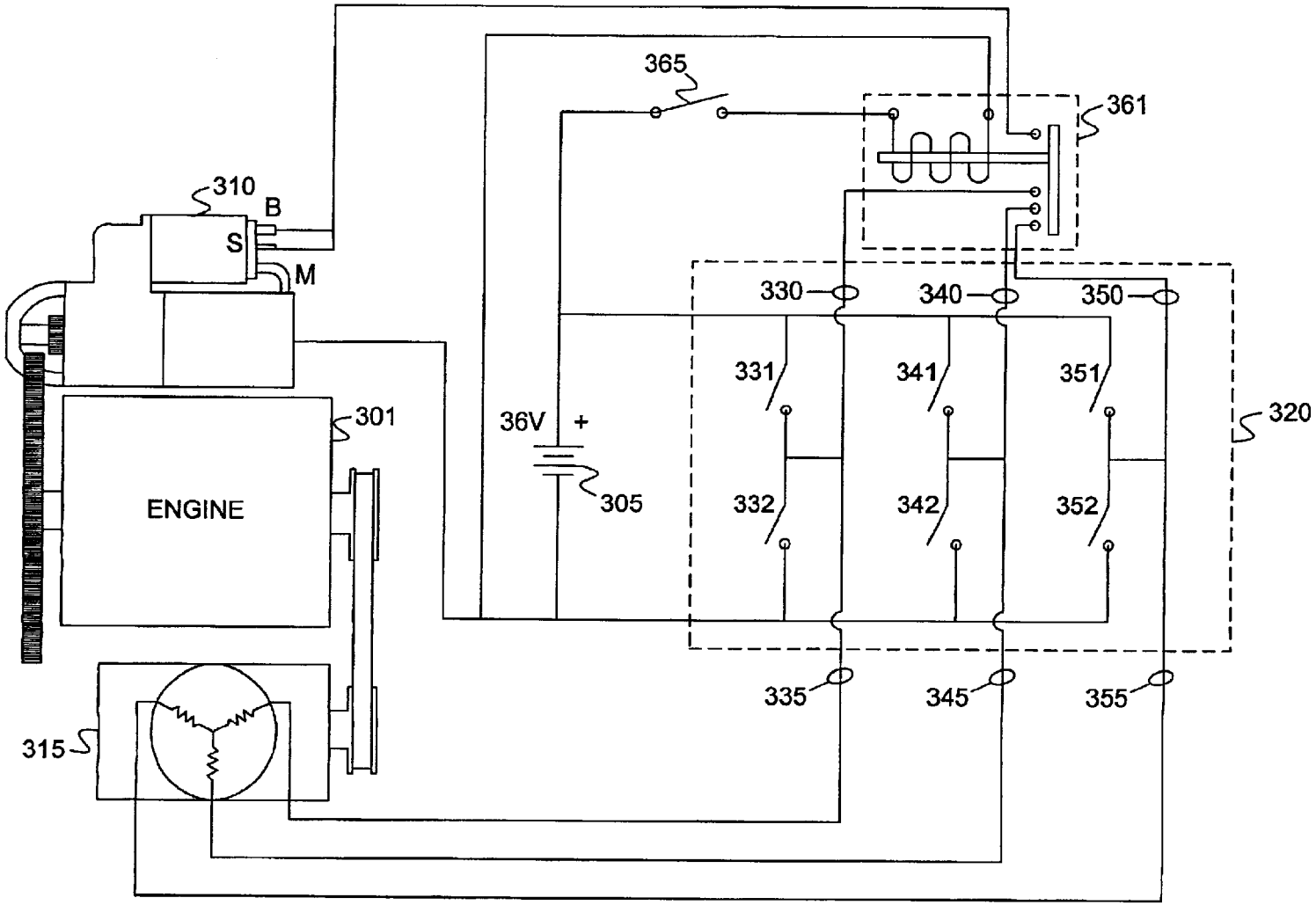
FIG. 4 is an exemplary block diagram of another electrical system in which the present invention may be practiced.

In alternative implementations, switch 360 may include a single moving contact along with one or more independent stationary contacts. Such an implementation is illustrated in FIG. 4. As illustrated, output terminals 330, 340, and 350 may each be coupled to three of the stationary contacts while starter 310 could be coupled to a fourth stationary contact. This configuration may prevent electrical circuit 320 from short-circuiting when switch 360 opens and may therefore render diodes 333, 343, 353 unnecessary.

Figure 4A:
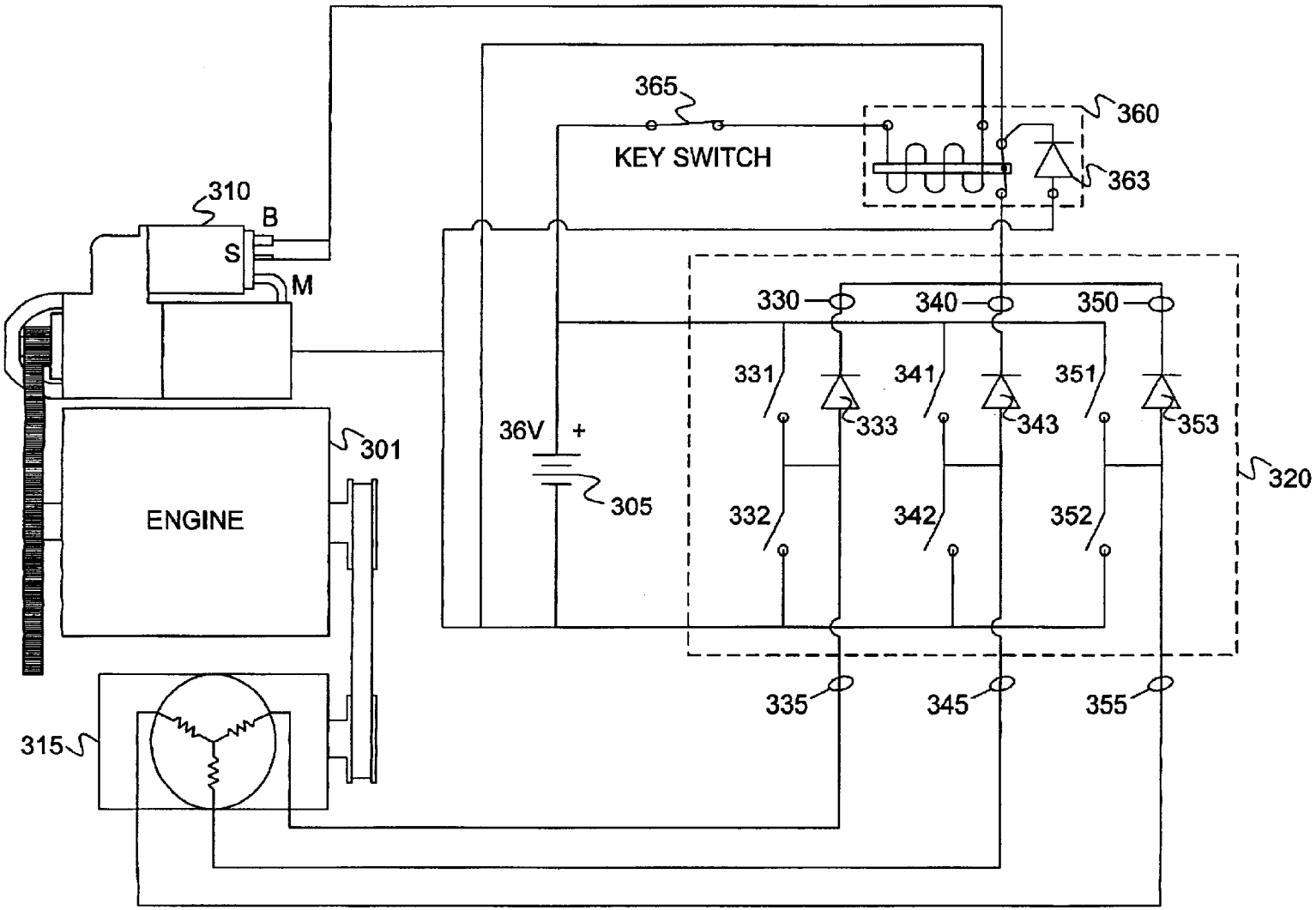
FIG. 4A is an exemplary block diagram of yet another electrical system in which the present invention may be practiced.

As FIG. 4A Illustrates, switch 360 may optionally include or be coupled to a diode 363 (or any other current-preventing element) connected in parallel with starter 310. In operation, diode 363 may be used to protect switching devices 331, 332, 341, 342, 351, and 352 from high voltage transients. Additional details associated with the functionality of diode 363 will be described below in connection with the flowchart of FIG. 5.

In one implementation, switch 360 may be coupled to voltage source 305 and mechanical switch 365. Mechanical switch 365 may be any type of switching device for connecting and disconnecting electrical current in response to a user action (i.e., a user-controlled switch). For example, mechanical switch 365 may be a key-driven switch or a push button switch and may cause current to flow in response to a key turning or a contact button being pushed.

A skilled artisan will realize that all of the components discussed in the foregoing and following description may be coupled via any combination of media capable of conducting electricity. Thus, all of the connections and terminals depicted in the accompanying Figures may be charge-transporting media.

For clarity of explanation, the foregoing description refers to FIG. 3, in which starter 310, starter-alternator 315, and engine 301 are depicted. It should, however, be understood that circuit 320 may be used to drive any low power device, mechanism or machine coupled to system 30 instead of starter 310. In addition, there may be any number of such electrical devices included in system 30. Likewise, instead of starter-alternator mechanism 315, any type and number of AC loads may be included in the system. Further, in alternative configurations, system 30 may not include starter-alternator 315 or any other AC load whatsoever. Similarly, in certain configurations, engine 310 could be absent from system 30. Accordingly, circuit 320 may be primarily used to provide a reduced average voltage.

Figure 5:
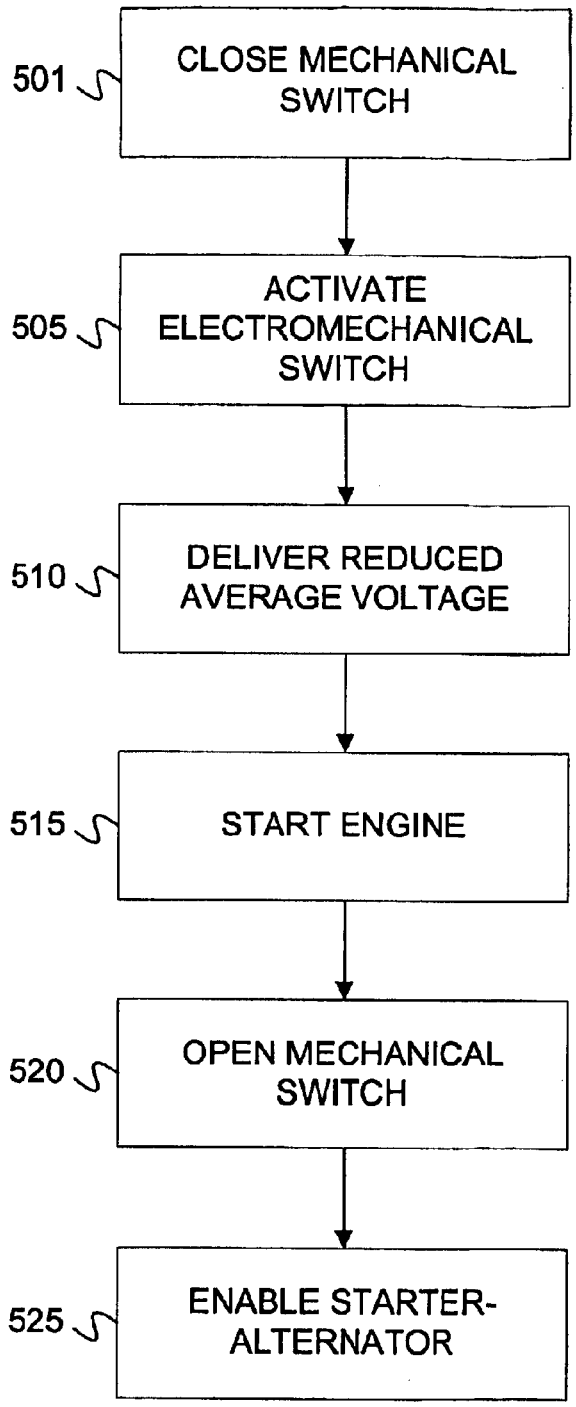
FIG. 5 is a flowchart graphically depicting steps of a method consistent with an exemplary implementation of the present invention.

In one exemplary implementation, operation of the invention may be consistent with the steps illustrated in the flowchart of FIG. 5. It should, however, be understood that other alternative method steps may be employed, and even with the method depicted in FIG. 5, the particular order of events may vary without departing from the scope of the invention. Further, certain steps may not be present and additional steps may be added without departing from the scope and spirit of the invention, as claimed.

Figure 6:
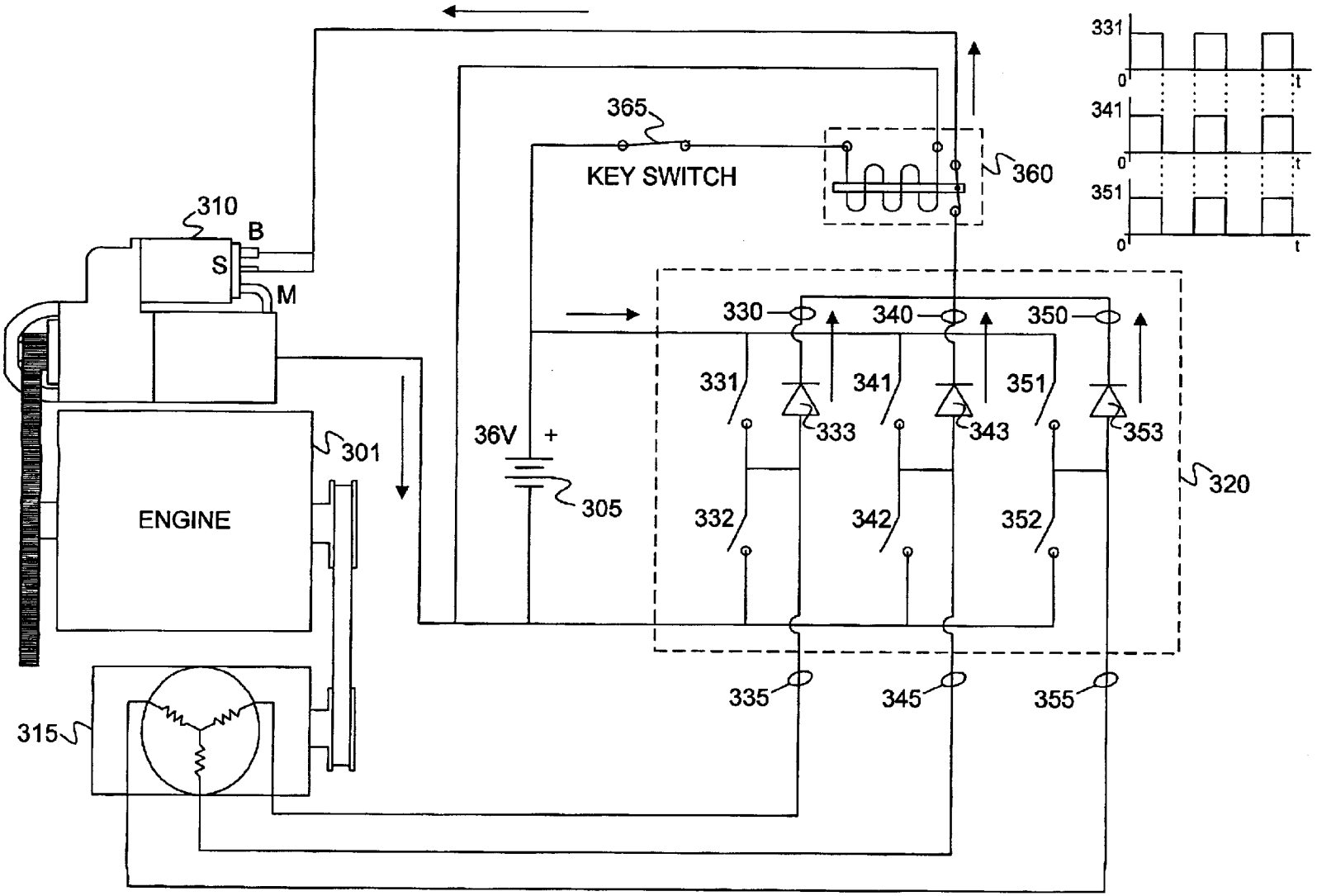
FIG. 6 is an exemplary block diagram depicting an operation of the present invention.

As indicated by step 501, mechanical switch 365 is switched closed. As explained above, this may involve a user turning a key or pushing a contact button. Consistent with principles of the invention, the user may dose switch 365 in order to cold crank engine 301. Once switch 365 is closed, an electrical current will flow into switch 360, thereby creating an electromagnetic field which activates switch 360 (step 505). During a cold crank, switching devices 332, 342, and 352 can be off or open, while switching devices 331, 341, and 351 are simultaneously pulsed to deliver the reduced average voltage to starter 310 (step 510). The reduced average voltage is provided via output terminals 330, 340, and 350 and routed through switch 360 to starter 310. In this fashion, electrical circuit 320 serves as a DC chopper allowing a high power battery to drive a low power starter. This action is graphically depicted in FIG. 6. At this point, starter-alternator 315 is not a load on-voltage source 305, since its terminals are maintained at equal potential.

After the engine starts (step 515), mechanical switch 365, and therefore switch 360, are switched open (step 520). At this point, the stored energy in the coils of starter 315 may produce an inductive voltage spike as coil currents decay, due to the L(dl/dt) effect. Accordingly, as previously indicated, diode 363 could be included in or coupled to switch 360 to short circuit any generated coil voltage, allowing current to continue to flow through the coils after switch 360 opens. This short circuiting will minimize the peak voltage applied to switching devices 331, 332, 341, 342, 351, and 352, and could be used to protect certain types of switching devices vulnerable to such voltages. For example, the inclusion of diode 363 may be desired to prevent certain semiconductor switching devices, having breakdown voltages which could be exceeded by a high applied voltage, from failing or causing other components to fail. A skilled artisan, however, will appreciate that, depending on the structure and properties of the switching devices, the inclusion of diode 363 may be unnecessary.

Figure 7:
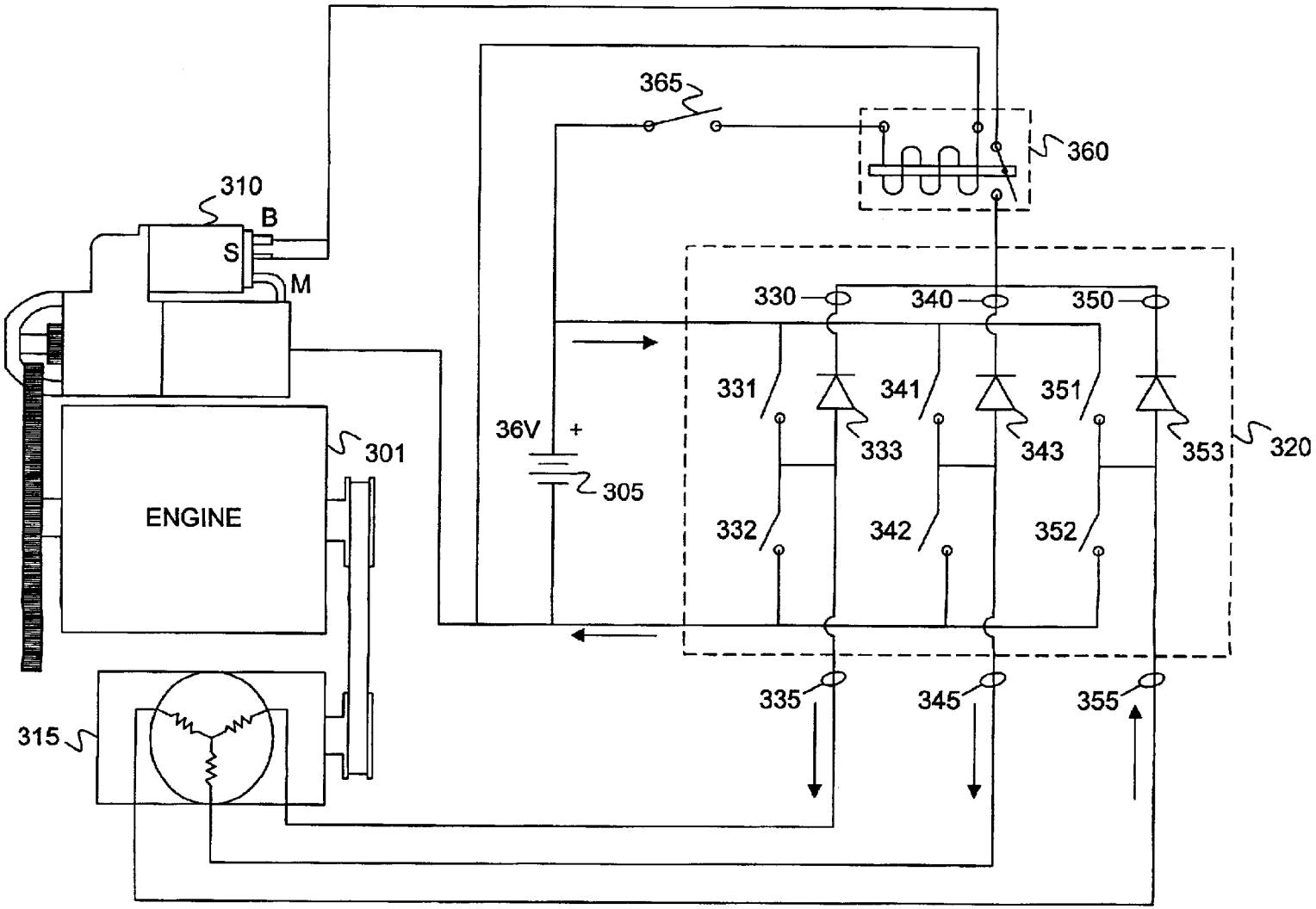
FIG. 7 is another exemplary block diagram depicting an operation of the present invention.

In response to mechanical switch 365 and/or switch 360 opening, circuit 320 will cease to provide the reduced average voltage and will operate as an inverter for starter-alternator 315. That is, circuit 320 will change modes of operation from a DC chopper mode to an AC inverter mode. Operation of circuit 320 as an inverter is graphically depicted in FIG. 7. As explained above, switching devices 331, 332, 341, 342, 351, and 352 may be sequentially switched to provide an adjustable-frequency alternating current to starter-alternator 315. In exemplary configurations, voltage and frequency (and therefore the switching devices) are controlled via a controller module.

Figure 5A:
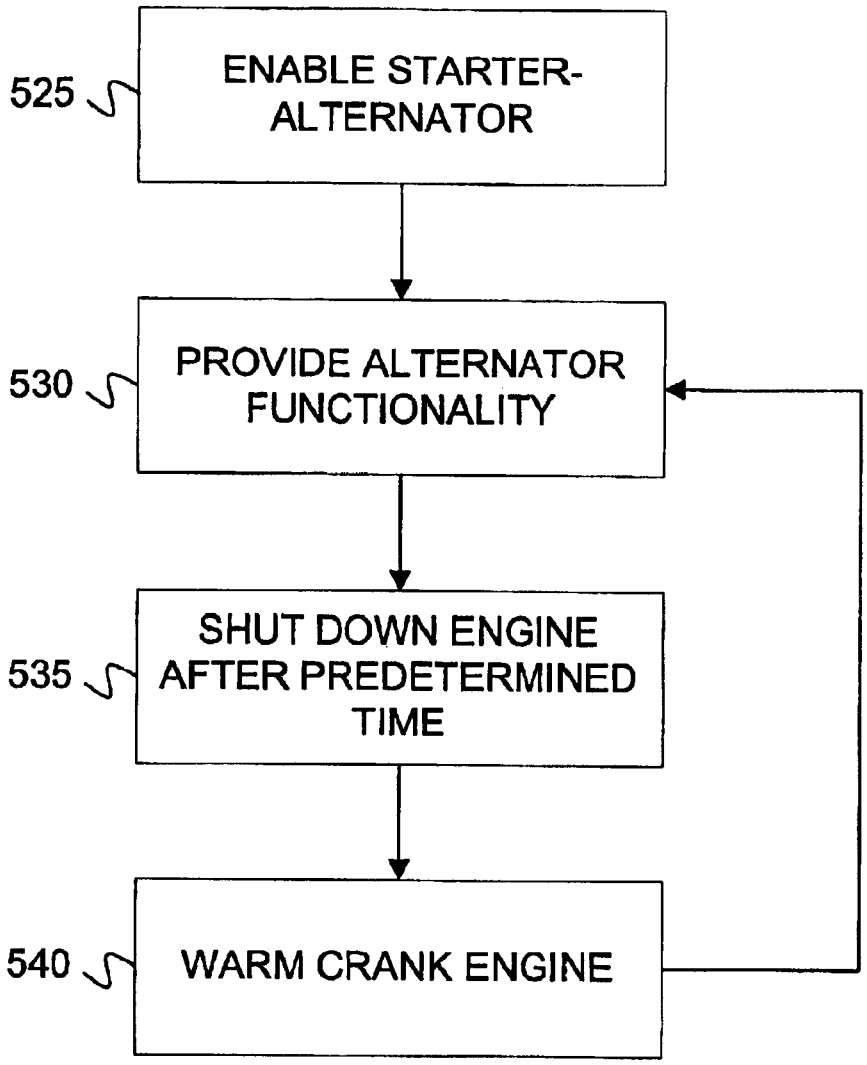
FIG. 5A is another flowchart graphically depicting steps of a method consistent with an exemplary implementation of the present invention.

After engine 301 is initially started by starter 310, starter-alternator 315 is enabled (step 525) and may operate as an alternator, as illustrated in step 530 of FIG. 5A. Starter-alternator 315 may convert energy produced by engine 301 (e.g., rotational energy) into an AC current, which can be converted to a DC current and used to-charge voltage source 305. The AC current may additionally or alternatively be used for powering other electrical devices residing in, or coupled to, system 30.

As explained above, engine 301 may be shut down (step 535) after extended periods of idle in order to, for example, reduce emissions and fuel consumption. In exemplary implementations, engine 301 may be shut down after a predetermined period of time (e.g., 10–60 seconds). Additionally or alternatively, the user may be able to set and adjust the time period and/or control when engine 301 is cut off. Further, in operation, the time period after which engine 301 is shut down may change with each instance.

After being shut down due to, for example, a prolonged idle period, engine 301 may be re-started (warm cranked) by starter-alternator 315, as illustrated in step 540. In operation, starter-alternator 315 may warm crank engine 301 in response to changes in the throttle and/ or clutch position. After warm cranking 301, starter-alternator may resume operation as an alternator (step 530). As the flowchart of FIG. 5A illustrates, starter-alternator 315 may continually serve as an alternator and starter until the start-stop ISA system is shut down. One skilled in the art will realize that the start-stop ISA system could be shut down by, for example, turning a key switch which could optionally cause a controller to generate a shut-down signal. A skilled artisan should also realize that engine 301 may be shut down and warm cranked any number of times before the start-stop ISA system is finally shut down.

It should be understood that processes described herein are not inherently related to any particular apparatus and may be implemented by any suitable combination of components. Further, various types of general purpose devices may be used in accordance with the teachings described herein. It may also prove advantageous to construct specialized apparatus to perform the method steps described herein.

It will be apparent to those skilled in the art that various modifications and variations can be made in the systems and methods of the invention as well as in the construction of this invention without departing from the scope of or spirit of the invention.

The invention has been described in relation to particular examples which are intended in all respects to be illustrative rather than restrictive. Those skilled in the art will appreciate that many different combinations of hardware, software, and firmware will be suitable for practicing the present invention.

Moreover, other implementations of the invention will be apparent to those skilled in the art from consideration of the specification and practice of the invention disclosed herein. It is intended that the specification and examples be considered as exemplary only. To this end, it is to be understood that inventive aspects lie in less than all features of a single foregoing disclosed implementation or configuration. Thus, the true scope and spirit of the invention is indicated by the following claims.

What is claimed is:

1. An electrical system comprising:

a direct current (DC) voltage source providing a first voltage;

an alternating current (AC) starter-alternator mechanism configured for warm cranking an engine and converting rotational energy from the engine into an AC current;

a starter mechanism, rated at a second voltage which is lower than the first voltage, for cold cranking the engine; and a circuit coupled to the voltage source for:

providing the second voltage to the starter mechanism in response to a switch closing; and in response to the switch opening, ceasing to provide the second voltage to the starter mechanism; transferring energy from the DC voltage source to the AC starter-alternator mechanism; and converting the AC current, converted from the engine by the starter-alternator, to a DC current in order to charge the voltage source.

2. The system of claim 1, wherein the circuit comprises at least one switching device.

3. The system of claim 1, wherein the AC starter-alternator mechanism includes n phases and wherein the circuit transfers energy by way of providing a set of n voltages substantially equal in magnitude and respectively displaced by a phase angle of 360°/n.

4. The system of claim 3, wherein each of the n phases are coupled to at least one switching device residing in the circuit.

5. The system of claim 2, wherein the at least one switching device is arranged in a converter configuration.

6. The system of claim 4, wherein the at least one switching device is arranged in a converter configuration.

7. The system of claim 2 further comprising a control mechanism for controlling the at least one switching device.

8. The system of claim 7, wherein the control mechanism sets an adjustable frequency at which the energy is transferred from the DC voltage source to the AC starter-alternator mechanism.

9. The system of claim 2, wherein the at least one switching device includes at least one of a MOSFET, a JFET, a BJT, and a thyristor.

10. The system of claim 1, wherein the switch is a magnetic switch.

11. The system of claim 1, wherein the switch is a single pole single throw magnetic switch and wherein the circuit comprises at least diode coupled to said switch.

12. The system of claim 2, wherein the at least one switching device is cooled via a heat sink.

13. The system of claim 12, wherein the heat sink transfers heat from the switching device via at least one of conduction, convection, and radiation.

14. The system of claim 1, wherein the first voltage is 36V and the second voltage is 12V.

15. The system of claim 1, wherein the switch is closed and opened in response to at least one of a key-driven starter switch and a push button starter switch.

16. An electrical circuit comprising:

at least one switching device coupled to a direct current (DC) voltage source providing a first voltage;

a first terminal set coupled to a switch, the first terminal set comprising at least one terminal coupled to the at least one switching device; and a second terminal set coupled to an AC load having at least one phase, the second terminal set comprising at least one terminal coupled to the at least one switching device, wherein the at least one switching device is pulsed in response to the switch closing, thereby providing, via the first terminal set, a reduced average voltage from the DC voltage source to a DC device; and wherein the at least one switch, in response to the switch opening, provides via the second terminal set, energy from the DC voltage source to the AC load.

17. The circuit of claim 16, wherein the AC load is a starter-alternator device for warm cranking an engine and converting rotational energy produced by the engine into an AC current.

18. The circuit of claim 17, wherein the circuit converts the AC current to a DC current and charges the DC voltage source.

19. The circuit of claim 16, wherein the DC device is a starter for cold cranking an engine.

20. The circuit of claim 16, wherein the AC load is an n-phase load and wherein the circuit provides energy to the n-phase load by way of providing a set of n voltages substantially equal in magnitude and respectively displaced by a phase angle of 360°/n.

21. The circuit of claim 16, wherein the at least one switching device is arranged in a converter configuration.

22. The circuit of claim 16, wherein the at least one switching device includes at least one of a MOSFET, a JFET, a BJT, and a thyristor.

23. The circuit of claim 16 further comprising at least one heat sink for cooling the at least one switching device.

24. The circuit of claim 23, wherein the at least one heat sink transfers heat from the at least one switching device via at least one of conduction, convection, and radiation.

25. The circuit of claim 16, wherein the switch is a magnetic switch.

26. The circuit of claim 25, wherein the magnetic switch is a single pole single throw magnetic switch.

27. The circuit of claim 26 further comprising at least one diode coupled in series to the at least one terminal included in the first terminal set.

28. The circuit of claim 16, wherein the switch is activated by at least one of a key-driven starter switch and a push button starter switch coupled to the voltage source.

29. The circuit of claim 16, wherein the first voltage is 36V and the reduced average voltage is 12V.

30. The circuit of claim 16, wherein the reduced average voltage is at least one of a pulse width modulated, hysteretic, and a chopped voltage.

31. An electrical system comprising:

a voltage source providing a first voltage;

an electrical device requiring a second voltage lower than the first voltage;

an alternating current.(AC) machine, having at least one phase, for converting rotational energy from an engine into an AC current;

a circuit coupled to the voltage source, the AC machine, and a switch;

wherein the circuit:

causes, in response to the switch closing, a reduced average voltage substantially equivalent to the second voltage to be provided from the voltage source to the electrical device; and in response to the switch opening, causes energy to be transferred from the voltage source to the AC machine and enables the voltage source to be charged via the AC current.

32. In a system having a voltage source providing a first voltage, a starter motor rated at a second voltage lower than the first voltage, a starter-alternator device, and an engine including a throttle and a clutch, a method comprising the steps of:

providing, in response to a user-controlled switch closing, a reduced average voltage substantially equal to the second voltage to the starter motor from the voltage source;

starting the engine via the starter motor;

providing, in response to the user controlled switch opening, the first voltage to the starter-alternator device from the voltage source;

charging the voltage source from the engine via the starter-alternator device;

stopping the engine after a predetermined period of time;

re-starting the engine via the starter-alternator device in response to a change in position of the throttle or clutch.

33. The method of claim 32, wherein providing the reduced average voltage to the starter motor from the voltage source comprises providing at least one of a pulse-width modulated and hysteretic voltage via at least one switching device.

34. The method of claim 32, wherein providing the first voltage to the starter-alternator device from the voltage source comprises providing a set of n voltages substantially equal in magnitude and respectively displaced by a phase angle of 360°/n.

35. The method of claim 33, wherein providing the reduced average voltage to the starter motor comprises providing the reduced average voltage via at least one of a MOSFET, a JFET, a BJT, and a thyristor.

36. In a system having a voltage source supplying a first voltage, a DC device, and AC load having a plurality of phases, a method comprising the steps of:

providing a reduced average voltage from: the voltage source to the DC device in response to a switch closing, wherein the reduced average voltage is lower than the first voltage; and transferring a plurality of voltages substantially equal in magnitude, each displaced by a phase angle, to the AC load from the voltage source in response to the switch opening.

37. The method of claim 36, wherein the providing step comprises providing the reduced average voltage from the voltage source to a DC starter motor rated at 12 volts.

38. The method of claim 36, wherein the transferring step comprises transferring a plurality of voltages to a starter-alternator device operating at 36 volts.

39. The method of claim 36, wherein the providing step comprises providing the reduced average voltage to the DC device by way of pulsing at least one switching device.

40. The method of claim 36, wherein the switch is a magnetic switch.

41. The method of claim 40, wherein the switch closes and opens in response to a user turning a key.

42. The method of claim 40, wherein the switch closes and opens in response to a user pushing a button.

* * * * *

UNITED STATES PATENT AND TRADEMARK OFFICE

CERTIFICATE OF CORRECTION

PATENT NO. : 6,744,146 B2
APPLICATION NO. : 10/234113
DATED : June 1, 2004
INVENTOR(S) : David A. Fulton et al.

It is certified that error appears in the above-identified patent and that said Letters Patent is hereby corrected as shown below:

* On the title page, item (57), in the Abstract, line 6, “warn” should read --warm--.

In claim 11, column 10, line 14, “least diode” should read --least one diode--.

In claim 30, column 11, line 12, “pulse width” should read --pulse-width--.

In claim 31, column 11, line 18, “current.(AC)” should read --current (AC)--.

In claim 36, column 12, line 23, “from:” should read --from--.

Signed and Sealed this

Twenty-second Day of May, 2007

JON W. DUDAS
*Director of the United States Patent and Trademark Office*